United States Patent [19]

Rehling et al.

[11] 4,407,331

[45] Oct. 4, 1983

[54] SPEED REGULATOR FOR THE WARP BEAM OF A WEAVING MACHINE

[76] Inventors: Walter Rehling, Poststrasse 63, Holzwickede, Fed. Rep. of Germany, 4755; Jaime Rossell, 10, Chemin du Valloni, Lausanne-Pully, Switzerland, CH-1012

[21] Appl. No.: 186,943

[22] Filed: Sep. 15, 1980

[30] Foreign Application Priority Data

Sep. 29, 1979 [DE] Fed. Rep. of Germany ..... 2939607

[51] Int. Cl.[3] ..... D03D 49/06; D03D 49/10

[52] U.S. Cl. ..... 139/110; 139/97; 242/75.51

[58] Field of Search ..... 139/110, 109, 108, 97, 139/100; 66/211; 242/75.51

[56] References Cited

U.S. PATENT DOCUMENTS

| | | | |
|---|---|---|---|
| 3,072,154 | 1/1963 | Locher | 139/110 |
| 3,125,127 | 3/1964 | Locher | 139/97 |
| 3,893,489 | 7/1975 | Bassing et al. | 139/110 |
| 4,129,154 | 12/1978 | Bennelli | 139/110 |
| 4,199,118 | 4/1980 | Tetro et al. | 242/75.51 |

FOREIGN PATENT DOCUMENTS

| | | | |
|---|---|---|---|
| 2155852 | 5/1973 | France | 139/110 |
| 371406 | 9/1963 | Switzerland | 139/110 |
| 372149 | 7/1973 | U.S.S.R. | 242/75.51 |

*Primary Examiner*—James Kee Chi

*Attorney, Agent, or Firm*—Biebel, French & Nauman

[57] ABSTRACT

A device for regulating the speed at which a weaving machine having a dancer is supplied with warp threads from a warp beam such that the speed and tension of the warp threads are substantially constant. The warp beam is provided with a variable speed drive having an alternatingly operable coupling and brake controlled by a regulator which compares the actual speed of the drive with a reference value. The actual speed is generated by an optical tachometer connected to the drive and the reference value represents an averaged number of dancer deflections and is generated by an integrator which receives the output of a potentiometer connected to the dancer.

5 Claims, 2 Drawing Figures

SPEED REGULATOR FOR THE WARP BEAM OF A WEAVING MACHINE

BACKGROUND OF THE INVENTION

This invention relates to regulating devices for rotary drives of winders wherein the material to be unwound is to be transferred with a high degree of constancy of velocity and a high degree of constancy of tension to another device. The winders of weaving machines are a prominent example where such regulating devices are needed. In that instance the movements of the dancer of the weaving device are used as the regulating quantity.

In weaving machines the warp threads should be supplied from the winder of the machines with as constant velocity and as constant tension as possible. In weaving the angular relation of the threads of the warp results in pulsating movements of its speed or velocity, and consequently the so-called dancer is also subject to small movements. The acceleration of the movements of the dancer decreases, as the constancy of the threads supplied by the warp beam increases. The more the evenness of the tension of the warp threads supplied by the warp beam increases, the smaller the movements of the dancer, and the smaller the mass of the dancer, so that the accelerating forces also remain small. This is the reason why dancers involving a large mass have not been used as a means for regulating the tension of the threads, or filaments. There is a trend toward minimizing the mass of the dancer, and to use the dancer as a storage means to regulate the rpms of the warp beam by a so-called "Two point control". In such a kind of control only the uppermost and the lowermost excursions or amplitudes of the dancer are used, but the smaller excursions of the dancer remain unused in the process of regulation. In other words, only the uppermost and the lowermost dead centers of the stroke of the dancer can be used for regulating purposes. This results in that the drive for the warp beam receives in the "Two point control" method only "on" or "off" commands. This results in that the warp beam of weaving machines having "Two point regulators" are always supplied with "on" or "off" commands, so that the supply of the warp filaments becomes too irregular and that their tension are subject to regular but unavoidable changes or variations.

The prior art Swiss Pat. No. 611,951 discloses means for maintaining continually constant the tension of the unwinding warp filaments. This is achieved by a mechanical regulating device. The stress of the warp filaments is applied to control an infinitely variable transmission which, in turn, controls the speed of the warp beam depending on the stress of the warp filaments. The device according to the above referred-to Swiss Patent has, however, two serious drawbacks. First, it depends on mechanical regulating means which are subject to wear and tear, and second it does not allow a reversal of the sense of rotation, i.e. to take up rather than to unwind filaments.

Other relevant prior art are DE-AS Pat. No. 16 13 350 (Deutsche Auslegeschrift) and DE-OS Pat. No. 26 27 658 (Deutsche Offenlegungsschrift). The former describes the alternative operation of a coupling and of a break for regulating the drive of sewing machines. The latter describes a positioning drive including alternately operating couplings and breaks.

It is, therefore, the primary object of this invention to provide a device of the kind specified above which enables a continuous regulation of the number of revolutions per unit of time of the warp beam without resorting to mechanical means such as, for instance, levers.

SUMMARY OF THE INVENTION

The invention relates to weaving machines having a dancer used for regulating purposes. A variable speed drive is provided for regulating the number of revolutions the warp beam is rotated per unit of time. The speed of the variable speed drive can be regulated, i.e. increased or decreased, as the case may be, by an auxiliary drive including an alternatingly operable coupling and brake. The speed drive of the warp beam is provided with a tachometer which converts its number of rotations per unit of time into corresponding electrical quantities or pulses. These electrical quantities or pulses are supplied as "real" or "active" values to a regulator, i.e. a device that maintains a desired quantity at a predetermined level by feeding back into the system the condition to be regulated.

The system according to this invention further includes a mechanical to electrical quantities conversion device such as, e.g. a second tachometer. This device converts the movements of the dancer into electric pulses, or vibrations. An integrator forms electric medium or average values of the movements of the dancer over predetermined equal periods of time. The output of that integrator is supplied as "desired" value to the regulator controlling the aforementioned variable speed drive.

The device according to this invention may further include a pulse counter for integrating a predetermined number of pulses derived from said second tachometer into a smaller number of pulses of longer duration of which each is the average of said predetermined number of pulses.

Conductor means supply said smaller number of pulses as "desired" value to the other of the input terminals of said regulator, and the output of the regulator alternately operates said coupling and said brake.

This device is capable of realizing in a simple and elegant way the requirement of regulating the number of revolutions of the warp beam of a weaving machine and to compensate for the decreasing diameter of the warp filaments which it supports.

Since the speed of supply of the warp filaments to the weaving machine is more constant, and their stress more even than in known prior art weaving machines, weaving machines having a device according to the present invention are capable of supplying woven products of superior quality.

The invention is based on the concept that a constant tension of the warp filaments is reached when the movements of the dancer become zero. Since this is not possible, the invention attempts to minimize the movements of the dancer by regulating before the filaments reach the dancer the speed of supply of the filaments to the dancer.

The vibrations of the dancer may be transformed by a potentiometer, or an equivalent device, into a train of electric pulses. This train of electric pulses is stored in an integrator and discharged from the latter by a pulse counter after a predetermined number of pulses have been counted and stored. Thus the pulses discharged from the integrator have the average value of the pulses stored therein. The number of pulses stored in the integrator prior to any discharge thereof may be in the order of ten.

Since the motions of the dancer are converted into electric pulses, an electric storage device may be arranged following the integrator storing the pulses produced by the dancer. In this embodiment of the invention the re-start of a weaving machine after a period of idleness may be effected with the pulses stored in the storing device, so that the number of revolutions of the warp beam after an operating pause is determined by its last number of revolutions prior to the operating pause. Since this mode of regulating a weaving device is costly, and may result in overshoots during the starting operation of the weaving device, it is preferable to provide the regulating device with an auxiliary or second starting supply for desired values, as set forth below in greater detail.

The regulation is effected by pulse-width control of approximately 100 pulses per second upon the coupling and the brake.

DESCRIPTION OF PREFERRED EMBODIMENT OF THE INVENTION

Figure 1:
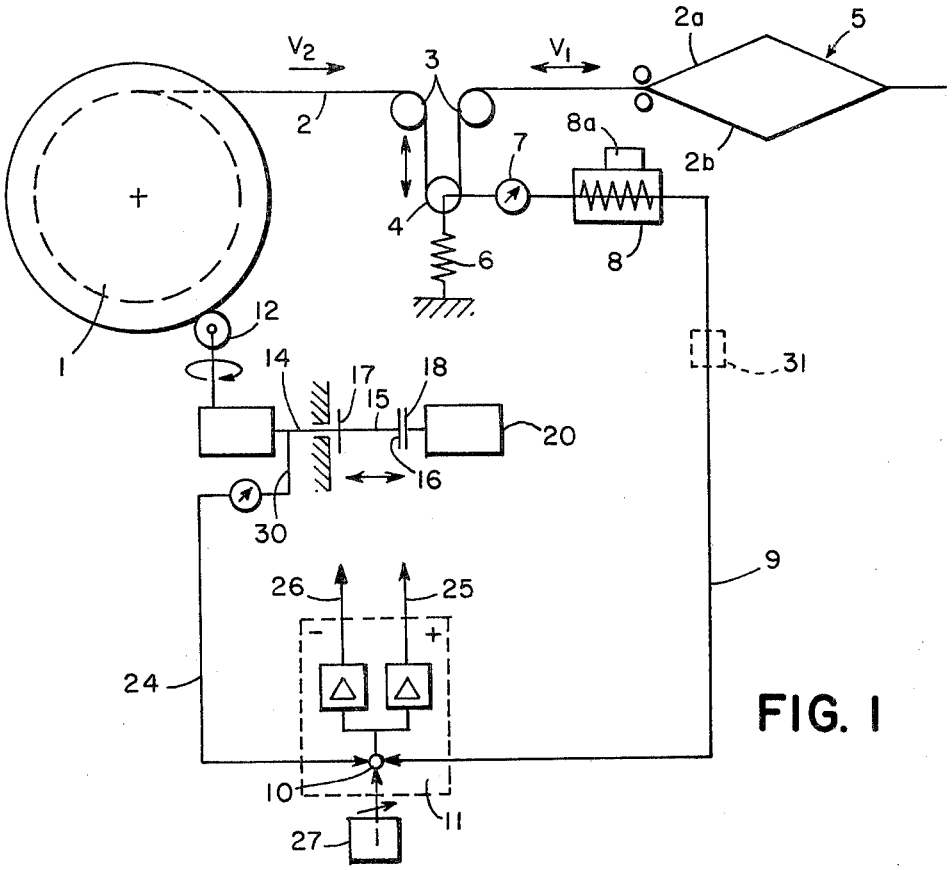
FIG. 1 is a diagrammatic representation of a device according to this invention for the warp beam of weaving machines.

Referring now to the drawings, and more particularly to FIG. 1 thereof, reference numeral 1 has been applied to indicate a warp beam of a weaving machine. The warp threads 2 extend from warp beam 1 to first change of direction roll 3, then to the so-called dancer 4, the second change of direction roll 3 to the weaving machine diagrammatically indicated at 5. The point where the upper warp threads separate from the lower warp threads are indicated by the reference character 2*a*. It is at this point where the woof threads are guided transversely through the warp threads. Because of this geometry, the path of the warp threads has a velocity $v_1$ behind rolls 3, while the threads are withdrawn from the warp beam, and have prior to reaching the rolls 3 the different velocity $v_2$. The differences in velocity are reduced by a so-called dancer which also serves the purpose to equalize the tension in warp threads 2. It would be necessary, in order to minimize the changes in tension, to equalize the velocity $v_2$ and the velocity $v_1$. This is, however, practically not feasible on account of the mass involved in the warp beam and the mass involved in the warp threads which are wound upon it. The dancer 4 and spring 6, therefore, constantly make small shifting movements. The smaller the acceleration of the shifting movements of the dancer 4, the more constant it is possible to maintain the velocity $V_2$. In addition, the smaller the mass of the dancer 4, the smaller the acceleration forces caused by movement of the dancer are, and it is these acceleration forces which ultimately affect the tension in the warp threads.

In order to match, as far as possible, the velocity $v_2$to the velocity $v_1$, the dancer 4 is operatively related to a potentiometer 7. This potentiometer 7 translates the mechanical movements of dancer 4 into corresponding differences in voltage which are integrated in an integrator 8 arranged downstream from potentiometer 7. The integrator 8 averages these voltage variations and includes a counter 8*a* which counts the number of voltage variations so that a reference value, which represents the average value arrived at after a predetermined number of deflections of the dancer 4, (e.g., after 10 dancer deflections), is generated. The reference value is transmitted from integrator 8 along line 9 to terminals 10 of an electronic regulator 11. This reference value is considered a "desired" value and, if desired, may be stored in storage device 31.

Figure 2:
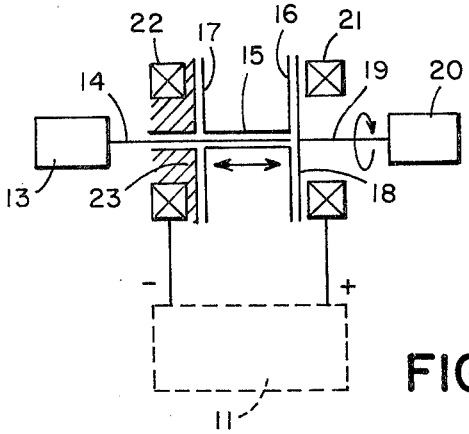
FIG. 2 is a diagrammatic representation of the mode of operation of a warp beam of a drive for a warp beam including the coupling and the brake.

The warp beam 1 is driven by a pinion 12 which, in turn, is driven by a variable gear-drive 13 which determines the number of revolutions of the warp beam 1. As mentioned above, the number of revolutions per minute of gear-drive 13 is variable. Rotational movement is transmitted by shafts 14 and 15. Shaft 14 is attached to gear drive 13 so that rotation of shaft 14 rotates pinion 12. Shaft 15 is hollow and receives shaft 14 therethrough such that rotation of shaft 15 rotates shaft 14 and at the same time shaft 15 is longitudinally displaceable relative to shaft 14. Shaft 15 is provided with a coupling 16 and a brake disk 17. Both coupling 16 and brake disk 17 are made of magnetizable material, or provided with parts of such material. Coupling 16 includes another coupling disk 18 which may be coupled with, and rotated by, the shaft 19 of a motor 20. (FIG. 2) The drive further includes electromagnets 21 and 22 which are energizable selectively. As a result shaft 15 may either be engaged by coupling disk 18 or by braking disk 23, of which the latter is stationary.

The regulation is effected over a range of approximately 100 impulses per second upon coupling and brake. Shaft 14 is provided with an optical tachometer 30 which transmits variable values of potential over line 24 to regulator 11. These variable values of potential depend upon the number of revolutions per unit of time of shaft 14. Reference numeral 10 has been applied to indicate the terminals of regulator 11 to which a train of voltage pulses is supplied through line 24. These voltages, or this train of voltages, correspond to the "real" or "actual" voltages, as distinguished from the "desired" voltage values. In other words, the medium values of the voltages corresponding to the movements of dancer 4 as "desired" values are compared with voltages of the rpms of drive 13 as "real" values or "actual" values. The difference of these two values is supplied to two channels 25 and 26, each including an amplifier. The positive or negative pulses resulting from this process, i.e. the output of channels 25 and 26, is supplied to the electromagnets 21,22 which control coupling 16 and brake 17. Thus the number of revolutions of pinion 12 and warp beam 1 may be held constant by this feedback process.

When applying this regulating device certain problems may arise when re-starting the weaving machine after a period of idleness. It would be possible to store the average value derived from integrator 8 and to use the same as "desired" value to be supplied to regulator 11 when, after a period of idleness, the machine is again put into operation. This solution requires a memory for storing the median values of the excursions of the dancer 4 and is also relatively complex. It is, therefore, desirable to provide the regulator 11 with an additional input means 27 supplying an adjustable voltage which may be used as the starting voltage. The voltage derived from input means 27 is of an empirical nature, and derived from the starting properties of the weaving machine 5. To put it in other words, starting of the weaving machine 5 is effected by an auxiliary voltage supply 27 which furnishes a desirable voltage determined by the starting properties of the particular weaving machine 5. At a later point of time, the voltage provided by voltage supply 27 is replaced by the voltage supplied by the "desired" voltage supplied by integrator 8. The provision of auxiliary input means 27 has also the advantage that the start of the weaving machine cannot be accompanied by an overshoot of the drive. To this end the voltage provided by device 27 is kept lower than the "desired" voltage derived from integrator 8.

We claim as our invention:

1. A speed regulator for a warp beam of a weaving machine comprising:

variable speed drive means for accelerating or breaking a rate of rotation of a warp beam;

means for generating a voltage output proportional to a deflection of a dancer which receives warp thread from a warp beam associated with said drive means;

integrator means for counting and averaging said voltage outputs and generating an averaged voltage representing a desired voltage value;

tachometer means connected to said drive means for generating a voltage proportional to said rate of rotation of a warp beam and representing an actual voltage value; and regulator means operatively connected to said drive means, said integrator means and said tachometer means for receiving said desired voltage value and said actual voltage value, comparing said voltage values, and selectively actuating said drive means in response to said voltage values to accelerate or brake a rate of rotation of an associated warp beam and thereby maintain tension of an associated warp thread substantially constant.

2. A speed regulator for a warp beam of a weaving machine comprising:

a warp beam carrying a length of warp thread;

dancer means including a downwardly biased dancer engaging said thread such that a tensioning or release of tension in said thread effects a displacement of said dancer;

means for generating a voltage output proportional to said deflection of said dancer;

integrator means for counting and averaging a predetermined number of said voltage outputs and generating an averaged voltage representing a desired voltage value;

variable speed drive means for accelerating or braking a rate of rotation of said warp beam;

tachometer means connected to said drive means for generating a voltage proportional to said rate of rotation of said warp beam and representing an actual voltage value; and regulator means operatively connected to said drive means, said integrator means, and said tachometer means for receiving and comparing said desired and actual voltage values and selectively actuating said drive means in response to a difference in said voltage values to accelerate or brake a rate of rotation of said warp beam such that said deflections of said dancer are minimized whereby the velocity of said warp thread fed to said dancer from said warp beam approaches the velocity of said warp thread downstream of said dancer when drawn into a weaving machine.

3. The regulator of claim 2 further comprising means for supplying an adjustable voltage to said regulator means which represents a starting desired voltage value.

4. The regulator of claim 2 wherein said drive means comprises:

means drivingly engaging said warp beam;

a first shaft fixed to said engaging means;

a second shaft drivingly engaging said first shaft and longitudinally displaceable relative thereto, said second shaft including a coupling disk and a brake disk.

motive means including a third shaft having a drive disk adjacent said coupling disk;

a fixed braking disk adjacent said brake disk;

means, actuated by said regulator means, for displacing said second shaft such that rotary motion is transmitted from said motive source, through said drive and coupling disks and said first and second shafts to said engaging means to rotate said engaging means and thereby accelerate said rate of rotation of said warp beam, or to displace said second shaft such that said brake and braking disks engage, whereby said rotation of sand first and second shafts is braked so that said driving means decelerates said rate of rotation of said warp beam.

5. The regulator of claim 4 wherein said displacing means includes electromagnet means positioned adjacent said coupling and brake disks, and said coupling and brake disks include magnetic means responsive to magnetic force generated by said electromagnetic means, said electromagnet means actuated by said regulator means.

* * * * *

UNITED STATES PATENT AND TRADEMARK OFFICE

CERTIFICATE OF CORRECTION

PATENT NO. : 4,407,331

DATED : October 4, 1983

INVENTOR(S) : Walter Rehling and Jaime Rossell

It is certified that error appears in the above—identified patent and that said Letters Patent is hereby corrected as shown below:

Col. 6, line 41, "sand" should be --said--.

Signed and Sealed this

Sixth Day of December 1983

[SEAL]

*Attest:*

GERALD J. MOSSINGHOFF

*Attesting Officer*

*Commissioner of Patents and Trademarks*